US005785667A

United States Patent [19]

Forner

[11] Patent Number: 5,785,667

[45] Date of Patent: Jul. 28, 1998

[54] GYMNASTIC IMPLEMENT

[76] Inventor: Flavio Forner, Via E. Dartora, 10, 31030 Pederobba (Prov. of Treviso), Italy

[21] Appl. No.: 812,471

[22] Filed: Mar. 6, 1997

Related U.S. Application Data

[63] Continuation-in-part of Ser. No. 398,821, Mar. 6, 1995, abandoned.

[30] Foreign Application Priority Data

Mar. 11, 1994 [IT] Italy ..... TV94A0032

[51] Int. Cl.[6] ..... A61H 1/00

[52] U.S. Cl. ..... 601/23; 601/35; 482/121; 482/132; 482/146

[58] Field of Search ..... 482/79, 92, 95, 482/110, 115, 117, 121–123, 125, 131, 132, 133, 139, 146, 147, 148, 908; 601/23, 33–35

[56] References Cited

U.S. PATENT DOCUMENTS

| | | | |
|---|---|---|---|
| 2,829,891 | 4/1958 | Ludwig | 482/146 |
| 4,191,371 | 3/1980 | Arner, Jr. | 482/146 |
| 4,787,630 | 11/1988 | Watson et al. | 482/146 |
| 5,346,451 | 9/1994 | Miller | 482/70 |
| 5,391,134 | 2/1995 | Heatwole | 482/146 |

FOREIGN PATENT DOCUMENTS

| | | | |
|---|---|---|---|
| 2592802 | 7/1987 | France | 482/146 |
| 2147212 | 5/1985 | United Kingdom | 482/117 |

*Primary Examiner*—Jeanne M. Clark
*Attorney, Agent, or Firm*—Guido Modiano; Albert Josif

[57] ABSTRACT

An improved gymnastic implement, particularly usable for physical reeducation, including a platform having, in a downward region, first supporting elements and second flexible rocking elements and, in an upper region, first seats for the user's feet and at least one second seat for one or more games of skill. The platform, or a frame for supporting it, has one or more pairs of lateral couplings for detachable supports with which user grip rods fitted with a shock absorber are rotatably associated. This gymnastic implement allows better and more gradual reeducation for rehabilitation and treatment of impaired parts of the body in disorders such as flat feet, talipes valgus, cavovalgus and cavovarus, bowleg, genu valgum, hip dysplasias, juvenile kyphosis, as well as habit and idiopathic scoliosis.

15 Claims, 2 Drawing Sheets

GYMNASTIC IMPLEMENT

This is a continuation-in-part of application Ser. No. 08/398,821, filed on Mar. 6, 1995, now abandoned.

BACKGROUND OF THE INVENTION

The present invention relates to an improved gymnastic implement particularly usable for physical reeducation.

Implements specifically designed for reeducating and recovering the foot, the leg, the spinal column, and all the parts of the body that contribute to keeping an upright posture are currently not commercially known.

Specific muscles, known as postural muscles and controlled by the cerebellum, help to maintain an upright antigravity posture; since these muscles are involuntary, their automatic action is controlled by an interplay of receptor information located in the sole of the foot.

The sole is also the starting point of muscle and ligament interventions as well as of the cerebellar pathways, that is to say, of the pathways that constantly supply information on the posture or position of the person.

Necessarily, when a person undergoes a trauma which affects the motor or postural parts of the body, as a consequence of sports activity or of any other collateral cause, these parts are impaired and severely damaged if the specific therapeutic remedies required by the individual case are not applied.

It is evident that the injured body part in any case involves the foot region, since that is where the receptor information for automating the control of muscle reflexes is located.

Accordingly, the injured body part is no longer receptive to the stimuli sent by the cerebellar pathways and therefore cannot fully contribute toward assuming the individual posture together with the other parts of the body, to the extent to which this was normally a natural action of that part; that is to say, it cannot contribute fully to the formation of the delicate mechanism of nerve, muscle, and tendon antagonism that allows balance as well as keeping an upright posture.

Gymnastic implements such as medicine-balls and orthopedic wall bars are currently being used; however, they have drawbacks as regards the particular problem being dealt with, either because the reeducation technique is not optimal, or because the particular physical effort required does not allow to cope with all age groups.

As a partial solution to some of these drawbacks, Italian Patent No. 1,245,571 which issued from Italian Patent Application No. MI91A000765, the disclosure of which is incorporated herein by reference, describes a gymnastic implement that comprises a platform having, in a downward region, first supporting means and second flexible rocking means and, in an upward region, first seats for counterweights, two or more second seats for the user's feet, and at least one third seat for one or more games of skill; although this solution is undoubtedly valid, drawbacks have been observed which are essentially due to the fact that the user, during reeducation, encounters difficulty in keeping his balance and therefore in performing the exercise continuously and correctly since he must control the position of the platform during rocking only with his feet.

It is thus possible to fall off the platform, and this might worsen the disorder of the user instead of improving it.

Furthermore, reeducation is possible only for the legs.

SUMMARY OF THE INVENTION

A principal aim of the present invention is to eliminate the drawbacks described above in known types of implement by providing an invention that allows to achieve gradual reeducation for rehabilitation and treatment of impaired parts of the body in disorders such as flat feet, talipes valgus, cavovalgus and cavovarus, bowleg, genu valgum, hip dysplasias, juvenile kyphosis, as well as habit and idiopathic scoliosis, albeit under strict medical control in this last case, and at the same time allows the user to have optimal balance control during reeducation.

Within the scope of this aim, an important object is to provide an implement which requires limited physical efforts when used, so as to cover the widest possible age range and allowing even older age groups to correctly perform reeducation by compensating for any problems in lack of balance.

Another object is to provide an implement that also allows to reeducate the arms.

Another important object of the invention is to allow adaptation to the specific requirements of each individual user.

Another object is to provide an implement that allows to contribute to the achievement of a perfect balancing of the foot, of the legs, and of the spinal column, allowing suitable basic preparation in bearing the loads and stresses typical of each type of sport.

Another important object is to provide an implement that is structurally simple and easy to industrialize and has low manufacturing costs.

Another object is to provide an implement that combines with the preceding characteristics that of being reliable and safe in use.

In accordance with one preferred aspect of the present invention, there is provided an improved gymnastic implement, particularly for physical reeducation, which includes: a platform structure having, in a downward region, supporting elements and flexible rocking elements and, in an upward region, a first area for a user's feet and a second area for one or more games of skill operationally dependent upon a rocking motion imparted to the platform structure by a user; a pair of user grip rods; a pair of supports each for a respective user grip rod; a pair of rotatable connections each for rotatably connecting an end of a respective user grip rod to a respective support; and a plurality of lateral couplings provided perimetrically about the platform structure for detachably and selectively coupling the pair of supports to the platform structure. The platform structure comprises a front portion at which the second area is positioned and a rear portion at which the first area is positioned, such that the rear portion has a shape which defines four corner portions including two forward corner portions and two rear corner portions relative to a direction a user substantially faces when standing on said first area, and the plurality of lateral couplings comprise four lateral couplings each arranged in proximity to a respective corner portion of the four corner portions of the rear portion of said platform structure.

In a preferred form of use of the improved gymnastic apparatus, a user stands on the first area at the rear portion of the platform structure so as to face the front portion of the platform structure whereat the second area is positioned at which a game of skill is positioned. In this manner the user may effectively see the game of skill.

The particular configuration of the plurality of lateral couplings at the four corner portions of the platform structure allows a user to select one of four different combinations of connecting positions of the two user grip rods, comprising: an arrangement of both grip rods connected at the two forward corner portions (mutually arranged oppositely with respect to the median longitudinal plane of the platform structure); an arrangement of both grip rods connected at the two rearward corner portions; an arrangement of a right user grip rod attached at a right lateral front corner portion and a left user grip rod attached to a left lateral rear corner portion; and an arrangement of a right user grip rod attached at a right lateral rear corner portion and a left user grip rod attached to a left lateral front corner portion. These latter two arrangements of the grip rod advantageously performs a helicoid-type reeducation of the shoulder and pelvic girdles.

According to another preferred aspect of the invention, the front portion has a curved front side and the plurality of lateral couplings further comprise two forward lateral couplings arranged at the curved front side essentially symmetrically with respect to a longitudinal axis of the platform structure, extending between the front and rear portions. In this manner the flexibility in use of the implement is further increased for greater adaptation to the specific requirements of particular users.

In preferred aspects of the invention, the platform structure is constituted by a board of plywood. A labyrinthine path for the rolling of a ball is formed at the second area of the front portion of the platform structure by superimposing (by using a numeric-control mill) part and a foot resting seat if formed at the first area of rear part of the platform structure. The labyrinth is covered by a sheet of semisoft transparent plastic (plexiglas) to prevent the accidental escape of the ball. The resting platform structure has an adequate length in order to be able to easily vary the position of the foot and is covered by a mat made of polyurethane or other materials with rounded cylindrical protrusions on its surface. The user grip rods may be composed of two telescopic rods made of aluminum or other materials, with an anatomical hand grip made of thermoplastic or other material, and are locked at the desired length by virtue of an axial rotation of the internal rod, which acts on an expansion-plug device. The grip rods may each be provided with shock absorber constituted by an outer tube made of extruded aluminum or other materials which is applied to the end of the inner rod with a threaded pin. The threaded pin acts as guide for the a piston, at the end of which a spherical joint is screwed; said joint supports both a bracket for fixing to the platform and a thermoplastic locking knob. The entire assembly is completed by a bush made of turned plastic which acts as a guide and contains the piston.

The platform is in turn supported by a frame which is composed of a part made of shaped metal plate obtained by laser cutting, to which it is electrode-welded. The frame, obtained from a drawn square profiled element, forms two parallel rails which have the purpose of containing a medicine-ball, which can be moved forwards and backwards at the therapist's discretion. It is possible to vary the pressure of the medicine-ball by virtue of a syringe-pump. Seven preferably vibration-damping feet are fixed to the frame and are distributed as follows: three fixed ones at the front, two at the center, provided with an aluminum shim, in such a manner as to adjust the distance of the support from the ground, two provided at the rear with a shock-absorbing system provided by virtue of a compression spring and the sliding of two coaxial tubes. Three seats in specific points, for the insertion of shock-absorbing telescopic grip rods, are provided in the two longer sides of the platform.

The apparatus of the invention is particularly useful for recovering the statics, dynamics, and sagittal and helicoid deviations of the rachis.

The elements that compose the apparatus according to the invention are based on neurophysiology principles which utilize the neurologic circuits that govern antigravity orthostatism and therefore allow to provide an intelligent and complete reeducation method which consists in sensory and motor "networking", thus allowing to combine subcortical (cerebellar) automatic reflex activity with voluntary and conscious activity involving the cortex (labyrinth).

The apparatus addresses many factors involved in regulating balance in human statics and kinetics, based on the following physiologicoanatomic background.

The sole of the foot is richly endowed with skin receptors (exteroceptors) and with proprioceptors.

Exteroceptors comprise: Meissner's corpuscles, located in the papillary layer, which are sensitive to deformations undergone by the papillae during skin compressions; the corpuscles of Golgi, located in the dermis, which react to light pressures; and the large pacinian corpuscles, which perceive intense pressures. Stimuli of exteroceptive sensitivity which ensure spatial and discriminatory awareness reach the rear fasciculus, where they constitute the two nuclei: the gracilis nucleus (Goll), constituted by fibers originating from the sacral, lumbar, and lower thoracic planes; and the cuneate nucleus (Burdach), constituted by fibers originating from the upper and cervical thoracic planes. These nuclei then continue up to the bulb, where relaying with the deuteroneuron occurs. The rear fasciculus comprises a group of proprioceptive sensitivity fibers which is associated with the exteroceptive fibers.

Proprioceptors are located at the muscles, tendons, bones, and articulations. There are many proprioceptors in the periosteum, in articular ligaments and capsules, and they have various shapes, similar to those of some exteroceptors, and are sensitive to pain and pressure. It is necessary to consider in particular two specific systems of proprioceptive receptors: the neuromuscular spindle, which is sensitive to the elongation of the muscle, and the Golgi tendon organ, which is sensitive to tension variations linked to muscle contraction.

The sensitive protoneuron which carries the stimuli of proprioceptive sensitivity enters the posterior horn of the spinal cord and splits, at this level, into a short descending branch and into an ascending branch which runs through the spinal cord and, without being interrupted, reaches the gracilis nucleus and cuneate nucleus of the bulb; it is then continued by the deuteroneuron, which produces the bulbothalamic bundle or lemniscus medialis, which after decussation reach the optical thalamus; the pathway that reaches the parietal cortex starts from the thalamus (the bundle and lemniscus relay deep conscious proprioceptive sensitivity).

At the level of its bifurcation, it generates short collateral branches which end medially at Clarke's column (the fibers of the deuteroneuron constitute Flechsig's direct spinocerebellar tract) and laterally at Bekhterev's nucleus (the fibers of the deuteroneuron decussate the median line to constitute Gowers' cruciate spinocerebellar tract).

The neck of the posterior horn constitutes the somatosensory region of unconscious proprioceptivity, which is the starting point of the two spinocerebellar tracts that end in the portion of the cerebellum which is phylogenetically most ancient, that is to say, the paleocerebellum, carrying proprioceptive impulses: the direct spinocerebellar tract carries the proprioceptive impulses of the trunk and upper limb, whilst the cruciate spinocerebellar tract carries the proprioceptive impulses of the pelvis and lower limbs.

In the upright position, postural stability is ensured both by feed-forward control mechanisms and by rapid feedback-based compensating corrections. Balance during walking and running is even more difficult to achieve. Maintaining postural stability requires the involvement of cortical and supraspinal centers.

If the conditions of the supporting platform change, as occurs for example when the patient is placed on an unstable and elastic platform, postural responses for maintaining the center of gravity above the center of the platform follow the distoproximal (craniocaudal) sequence.

When the body tilts forwards, the extensors of the ankle (such as the gastrocnemius) contract first, whilst when the body tilts backwards the front tibial muscle, which is the flexor of the ankle, contracts first.

Postural responses are triggered by three kinds of sensory afferent pathways: muscle proprioceptors, which detect variations in length or tension of the muscles of the sole of the foot; vestibular receptors, which detect the inclination of the body on the basis of the movement of the head; and visual afferent pathways, which transmit information on the movement of the viewing field.

In order to obtain a complete postural response, visual, proprioceptive, and vestibular information must be correlated to each other.

The postural response of a patient to a stimulus which affects posture is modified by experience and the response that best tends to maintain balance is selected.

When a voluntary action is performed, the postural muscles contract before performing the movement. The supplementary motor area is important in this process.

Postural corrections to avoid losing balance are activated both by means of feed-forward control mechanisms and, if disturbances are present, with the aid of feedback mechanisms which generate rapid corrective responses.

The afferent information that triggers these responses rises through the dorsal column-lemniscus medialis system up to the thalamus, from where they are retransmitted to the primary motor cortex.

The alignment of the head and neck with respect to the force of gravity in a patient placed on a platform subjected to disturbance uses vestibular and cervical reflexes.

Both kinds of reflex act by generating coordinated responses of the muscles of the arms, legs, and neck. Head movements also induce vestibuloocular reflexes.

The reticulospinal system coordinates posture and movement, integrating the vestibular signals and those originating from other sensory afferent pathways with the commands that arrive from the cerebral cortex.

The pneumatic support of the moving platform and the grip rods of the apparatus according to the invention ensure the gradual production of a dual physiological phenomenon. Various parts of the body take part, in a purely reflex manner, in this deep sensitivity: all the articulations of the lower limb, by involving the chains of foot extensors and flexors; the pelvic girdle by virtue of the action of the pes anserinus; the somatic center of gravity, located in front of L3, first movable verterbra free from the rachis in orthostatism; and, therefore, all of lumbar lordosis, for which L3 is the integrating element; all of the shoulder girdle, which is mobilized to readjust the balance that has thus been altered; and all of the cervical rachis, by virtue of the movements required to adjust the bivestibular planes.

The grip rods of the invention (preferably vibration-damping) limit the inclination of the platform and thus avoid untimely falls.

Moreover, activation of deep baronsensitivity is linked to the involvement of the various articular and somatic baroreceptors, induced by the pneumatic oscillations on the ball inflated to varying extents. Every pressure reduction slows oscillations, and every pressure increase is accompanied by an exaggeration of baroreceptive pulses and requires an intensification of reflex activity.

The two grip rods of the apparatus according to the invention may be placed on either side of the platform in various manners, including connecting one grip rod to the platform at one lateral side and forwardly while connecting one grip rod to the platform at the other lateral side and rearwardly, thus allowing a helicoid-type reeducation of the shoulder and pelvic girdles. The kinetic muscles of the upper limbs thus counterbalance the reflex action of the postural muscles. This kind of restructuring is one of the most effective means for morphological recovery of scolioses.

Exercise on the platform on an elastic support allows the reflex involvement of all cerebellar systems and of synergistic, agonistic, and antagonistic functional muscle groups.

The ARCHICEREBELLUM is in relation with the vestibular inner ear. It regulates balance. This is the most intensely stressed system when the body is off balance, during walking and running. It is connected to the muscles of the deep layer: the short flexor and the adductor of the hallux.

The PALEOCEREBELLUM is the neurologic element which manages the human body's somatic relations with earth gravity: it controls the postural tonus of the somatic muscles charged with counterbalancing the effect of the force of gravity and regulates the tonus of the muscle chains of our orthostatism. Postural muscles, activated by reflex pathways starting from the proprioceptive peripheral receptors of the surface muscle layer of the sole of the foot (plantaris brevis and flexor longus of the toes) are connected to the paleocerebellum by means of the following spinocerebellar tracts:

a) Flechsig's direct tract, which carries proprioceptive sensitivity of the thorax and of the upper limb. It rises up to the homolateral lower paleocerebellar cortex through the inferior cerebellar peduncle; and b) Gowers' cruciate tract, which carries proprioceptive sensitivity of the pelvis and of the lower limb, decussates as soon as it reaches the medulla (at the level of D12), rises along the contralateral cord up to the brainstem, and then descends along the superior cerebellar peduncle to end at the central lobule, in the culmen, and in the cerebellar quadrangular lobule. Accordingly, it connects the lower somatic region to the contralateral superior paleocerebellar cortex. The opposite action between the upper body half, guided by the direct tract, and the lower body half, controlled by the indirect tract, leads in walking to a physiological alternating and balanced scoliotic posture, of which D12 is the pivotal vertebra.

The NEOCEREBELLUM is the central system which harmonizes the synergistic, agonistic, and antagonistic muscle structures and the perfect organization of somatic torsions about the three spatial axes: frontal, sagittal, and torsional, integrated by the muscles of the medium plantar layer (alternating system constituted by lumbricals and Silvio's quadratus).

Two chains termed "EXTENSOR CHAIN" and a "FLEXOR CHAIN", according to their podal starting point, relate to the activity of two complementary and sagittally alternating muscle chains which control, in a fully reflex manner, antigravity somatic upright posture, both during upright standing and during walking, running, jumping etc.

While from a mechanical point of view the position of a ball of the flexible rocking elements of the apparatus according to the invention affects the sagittal movement of the lumbar, dorsal, and cervical rachis, its hardness or elasticity affect the proprioceptive neurologic receptors which have a central cerebellar effect.

In accordance with the invention, contact with the platform is direct for the feet and indirect for the upper limbs by means of the grip rods.

In order to optimize proprioceptive recovery, it is recommendable to place the supporting elements (preferably vibration-damping feet) as far away as possible from the platform, in order to minimize the stroke of the rocking motion and thus hinder cerebellar memorization.

In accordance with another aspect of the invention, the flexible rocking elements comprise an inflatable ball which is arranged at the downward region of the platform structure selectively in one of a plurality of positions between a front and a rear of said platform structure.

In practice, depending on whether the ball is placed further forwards or backwards in a track while the feet are in a symmetrical position, one acts predominantly on one chain or the other; this process is used to recover sagittal deformations of the rachis. Therefore, feet backwards results in a center of gravity forwards, while feet forwards results in center of gravity backwards. If instead the patient is placed on the platform and the position of the ball is changed with one foot placed forwards and the other foot arranged backwards, one notices that the patient places himself: a) under a physiological helicoid torsion, if the position of the grip rods matches the helicoid torsions of walking, and b) in a recovery position, adequately varying the position and grip of the grip rods. This last method is used to recover scolioses.

The grip rods in a front and symmetrical position helps in recovery of the shoulder girdle and of curved backs. In the recovery of scolioses, the position of the feet acts on vertebral rotation, whilst the position of the grip rods acts on lateral deviations.

In accordance with another aspect of the invention, the grip rods are provided, at the level of the anchoring point, with a spring-loaded shock absorber which has, for the upper limbs, the same proprioceptive function as the elastic ball.

This is a valid support also in the prevention and treatment of various disorders of the foot, of the limbs (constituting an alternative to postural techniques, which require long recovery times and higher costs and are mostly ineffective because they are techniques based on "cortical" voluntary control which do not correspond to the physiology of cerebellar and subcortical reflex orthostatism).

With regard to use of the apparatus of the invention, training should be gentle, cautious, and gradual to avoid overloading the antigravity postural muscles. The onset of signs of fatigue (sweating, nausea, vertigo, horripilation, pallor, etc.) of pain or of muscle cramps requires immediate suspension of the exercise, which should be safely resumed only when the symptoms cease. The duration, type, and frequency of the exercises vary according to the clinical condition.

Generally, one begins by placing the ball in a central position, with the feet in a symmetrical position; timings must increase gradually up to a maximum of twenty–thirty minutes, and the hardness of the ball must vary so as to increase or decrease in order to stimulate cerebellar reflex activity. Subsequently, one moves on to exercises in which the ball is gradually placed at the front or at the rear, but always keeping the feet in a symmetrical position. Asymmetrical placement of the feet, with consequent somatic helicoid rotations, must be undertaken under strict control of a doctor or physiotherapist.

BRIEF DESCRIPTION OF THE DRAWINGS

Further characteristics and advantages of the invention will become apparent from the following detailed description of a particular embodiment thereof, illustrated in the accompanying drawings, wherein.

DESCRIPTION OF THE PREFERRED EMBODIMENTS

Figure 1:
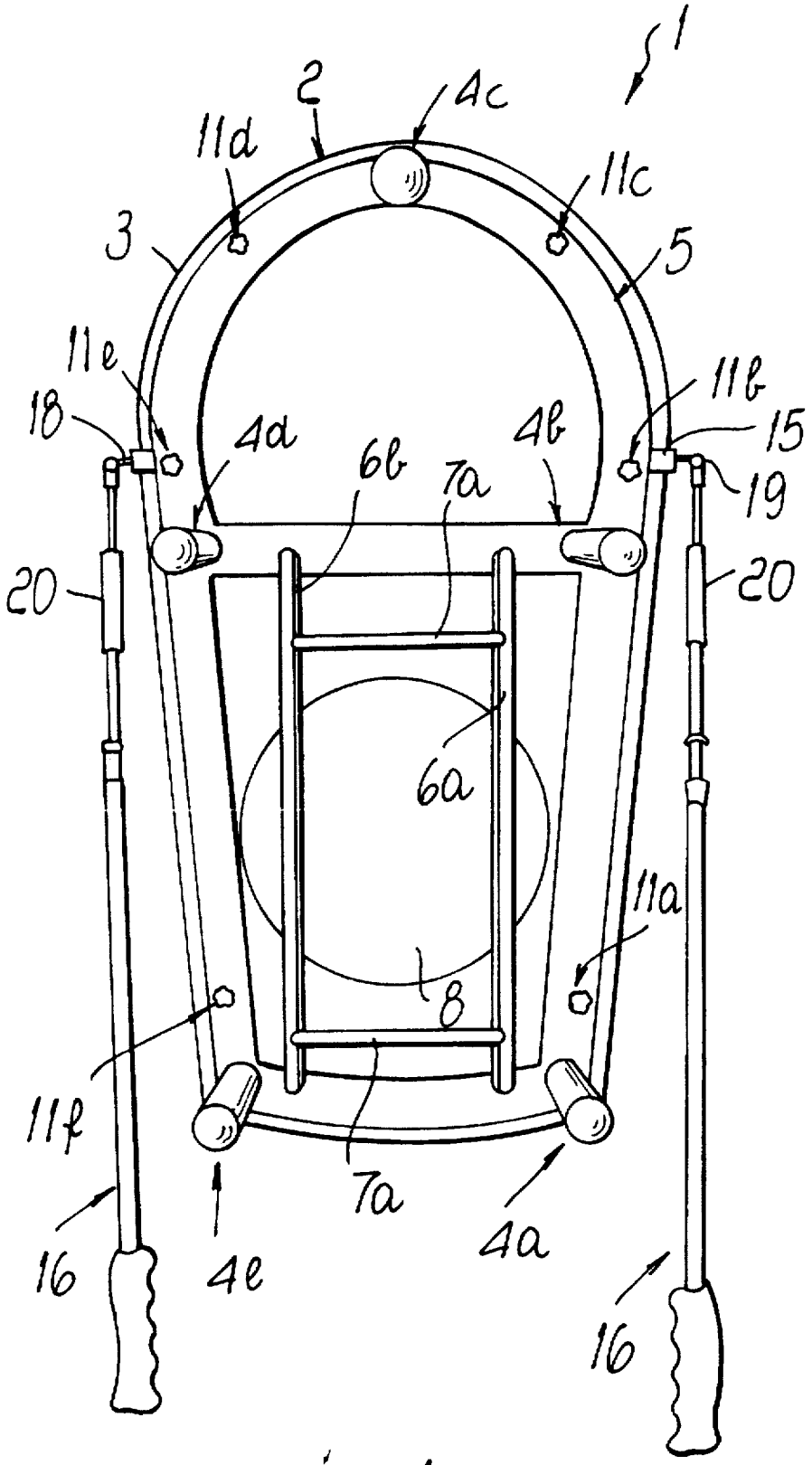
FIG. 1 is a bottom view of the improved gymnastic implement according to the present invention.
Figure 2:
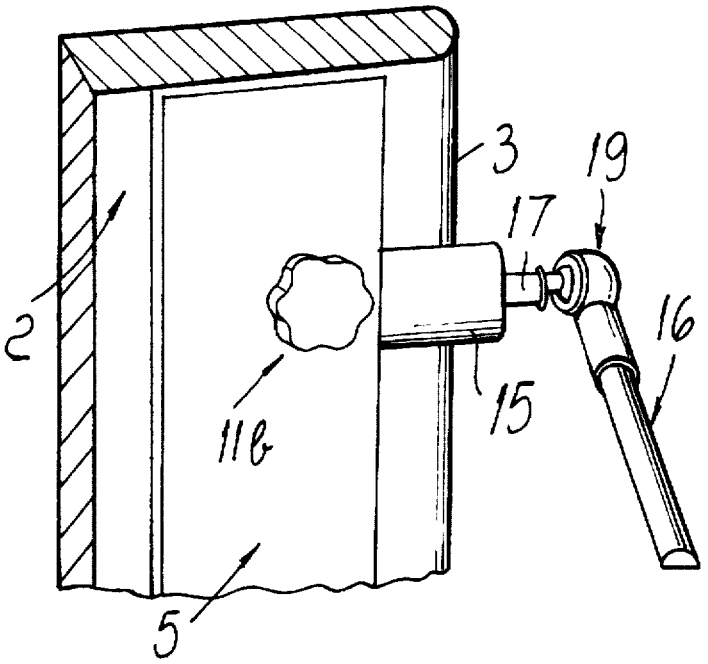
FIG. 2 is a detail view of a coupling for a detachable support with which a user grip rod is rotatably associated.
Figure 3:
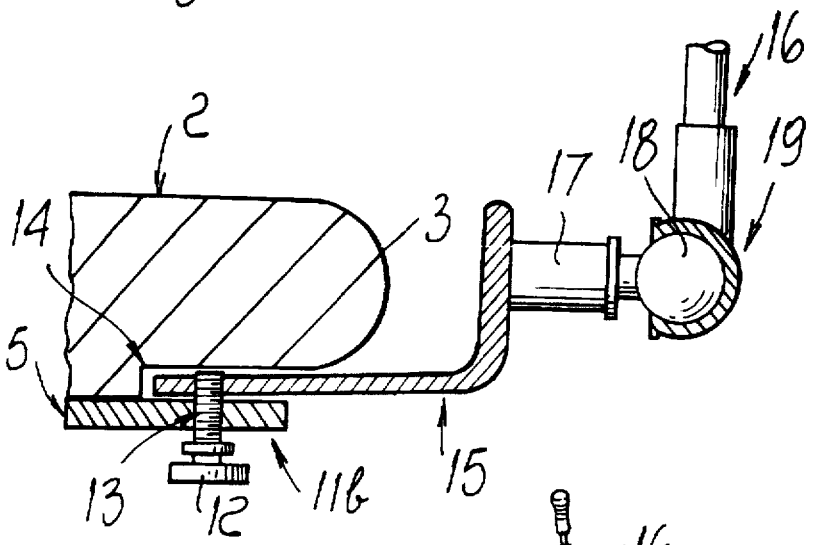
FIG. 3 is a sectional view of the coupling for a support with which the user grip rod is associated.
Figure 4:
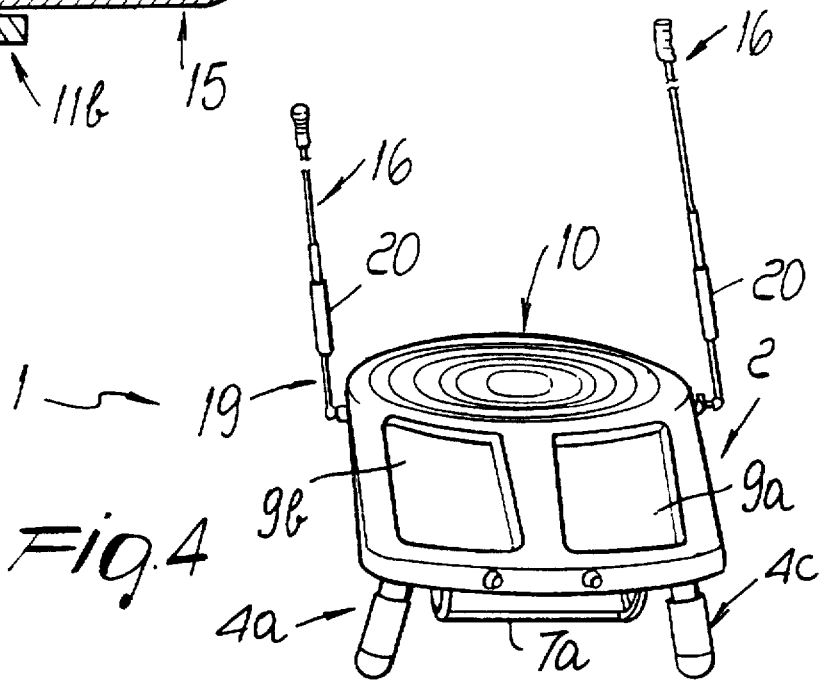
FIG. 4 is a rear view of the improved gymnastic implement.

With reference to the above figures, the improved gymnastic implement, generally designated by the reference numeral 1, includes a substantially flat platform 2 having an essentially rectangular plan shape with a curved front side; the width of said platform allows the user to stand thereon with his feet apart to a greater or smaller extent.

Supporting means or elements, designated by the reference numerals 4*a*, 4*b*, 4*c*, 4*d*, and 4*e*, are associated below said platform 2 proximate to its perimetric edge 3 and are constituted by feet, optionally fitted with shock absorbers, adapted to interact with the ground and associated with a frame 5 that is in turn rigidly coupled below the platform 2.

The ends of rocking means or elements, functioning similarly to the rocking means described in the previously mentioned Italian Patent No. 1,245,571, are associated parallel to the longitudinal median axis of said platform 2 and comprise at least one pair of bars 6*a* and 6*b* which are mutually connected by two cross-members 7*a* and 7*b* between which an inflatable ball 8 can be placed.

Said platform 2 has, in an upward region, two first seats 9*a* and 9*b* for accommodating the user's feet.

A second seat for a game of skill 10 is placed or formed at the front side of the platform; the game of skill is, in the specific case, a labyrinth-like path inside which a ball can be placed.

The platform 2 or the frame 5 have, in a downward region and proximate to the perimetric edge 3, one or more pairs of couplings, designated by the reference numerals 11*a*, 11*b*, 11*c*, 11*d*, 11*e*, and 11*f*, each of which is constituted by a locking means, such as a knob 12, the threaded stem 13 whereof can be associated within a first complementarily threaded hole formed in said platform or frame.

A third seat 14 is formed at the first hole, transversely to said overlying platform, and accommodates a support 15 which is constituted by an essentially L-shaped plate; a user grip rod 16 is rotatably associable with the wing of said plate that is laterally adjacent to said perimetric edge 3 of the platform.

A sleeve 17 is associated with said wing, and a ball 18 is associated with the loose end of said sleeve; a complementarily shaped socket joint 19 interacts with said ball, and one end of the rod 16 is rigidly coupled to said joint.

Said rod has at least one axial shock absorber 20 which is suitable to compensate for any forces applied to the rod by the user during exercise, so as to force said user to resume a correct position, thus making his muscles work better.

Said shock absorber has a stroke limiter that is suitable to support the user before he loses his balance completely.

The operation of the improved gymnastic implement described above is as follows: once the ball has been associated below the platform, the user can climb onto said platform while holding onto the rods 16.

Said rods are associated beforehand with the desired pair among the pairs of couplings, so that the rods are at the level of the hips or in front or behind them according to the particular reeducation to be performed.

The rocking motion of the platform can thus be controlled by the user by virtue of the fact that by gripping the rods he can keep his balance better and has a direct support by means of his hands and therefore performs work for the arms as well, without curving his back.

Advantageously, this particular movement stimulates and appropriately energizes the vertebral region and the knee ligament region as well as the arms, producing considerable physical improvements in individuals affected by orthopedic or traumatic disorders.

It has thus been observed that the invention has achieved the above mentioned aim and objects, an implement having been obtained that allows gradual reeducation for rehabilitation and treatment of impaired parts of the body in disorders such as flat feet, talipes valgus, cavovalgus and cavovarus, bowleg, genu valgum, hip dysplasias, juvenile kyphosis, as well as habit and idiopathic scoliosis, albeit under strict medical control in this last case, and of the arms, at the same time giving the user optimal control over his balance during reeducation activity.

Said implement allows to reeducate the foot, the arms, and the specific muscles of posture, by stimulating and energizing the neurophysiologic functions of the foot and the orthostatic plantar reflexes even in older age ranges, in which it may be more difficult to assume and maintain a balanced position.

This particular implement, after careful reeducation of the limbs, is extremely adapted for recovering muscle tone after immobilizations due to fractures or after spinal column surgery.

The invention is of course susceptible of numerous modifications and variations, all of which are within the scope of the same inventive concept.

Of course, the materials and the dimensions that constitute the individual components of the implement may also be the most appropriate according to the specific requirements.

What is claimed is:

1. Improved gymnastic implement, particularly for physical reeducation, comprising:

a platform structure having, in a downward region, first supporting means and second flexible rocking means and, in an upward region, first seats for a user's feet and at least one second seat for one or more games of skill operationally dependent upon a rocking motion imparted to said platform structure by a user;

a pair of user grip rods each fitted with a shock absorber;

a pair of supports each for a respective user grip rod of said pair of user grip rods;

a pair of rotatable connections each for rotatably connecting an end of a respective user grip rod to a respective support of said pair of supports; and a plurality of lateral couplings provided perimetrically about said platform structure for detachably and selectively coupling said pair of supports to said platform structure;

wherein said platform structure comprises a front portion at which said at least one second seat is provided and a rear portion at which said first seats are provided, said rear portion having an essentially rectangular planar shape;

and wherein said plurality of lateral couplings comprise four lateral couplings each arranged in proximity to a respective corner of said rear portion of said platform structure.

2. Implement according to claim 1, wherein said platform structure is provided with, in a downward region and proximate to a perimetric edge of said platform structure, said plurality of lateral couplings, each coupling of said plurality of lateral couplings comprising:

a threaded hole formed in said platform structure; and a locking means with a threaded stem which is releasably screwed in said threaded hole.

3. Implement according to claim 2, wherein a third seat is formed in said platform structure at said threaded hole, each support of said pair of supports comprising a wing which is selectively arrangeable in said third seat, said wing being provided with a threaded hole into which said threaded stem is screwable to connect said wing to said platform structure.

4. Implement according to claim 3, wherein said wing is part of an L-shaped plate of said support, a sleeve being connected to said L-shape plate, a ball being connected to said sleeve, a complimentarily shaped socket joint interacting with said ball, said end of a respective user grip rod being rigidly coupled to said joint.

5. Implement according to claim 1, wherein said front portion has a curved front side and wherein said plurality of lateral couplings further comprise two forward lateral couplings arranged at said curved front side essentially symmetrically with respect to a longitudinal axis of said platform structure.

6. Implement according to claim 1 wherein each support of said pair of supports comprises a sleeve which extends laterally from said platform structure when said each support is connected to said platform structure, and wherein each rotatable connection of said pair of rotatable connections comprises a ball element connected to a free end of said sleeve and a socket joint connected to said end of a respective user grip rod, said socket joint being shaped complimentarily to said ball and being rotatably engaged about said ball.

7. Improved gymnastic implement, particularly for physical reeducation, comprising:

a platform structure having, in a downward region, supporting elements and flexible rocking elements and, in an upward region, a first area for a user's feet and a second area for one or more games of skill operationally dependent upon a rocking motion imparted to said platform structure by a user;

a pair of user grip rods;

a pair of supports each for a respective user grip rod of said pair of user grip rods;

a pair of rotatable connections each for rotatably connecting an end of a respective user grip rod to a respective support of said pair of supports; and a plurality of lateral couplings provided perimetrically about said platform structure for detachably and selectively coupling said pair of supports to said platform structure;

wherein said platform structure comprises a front portion at which said second area is arranged and a rear portion at which said first area is arranged, said rear portion having a shape which defines four corner portions, said four corner portions including two forward corner portions and two rear corner portions;

and wherein said plurality of lateral couplings comprise four lateral couplings each arranged in proximity to a respective corner portion of said four corner portions of said rear portion of said platform structure.

8. Implement according to claim 7, wherein said platform structure is provided with, in a downward region and proximate to a perimetric edge of said platform structure, said plurality of lateral couplings, each coupling of said plurality of lateral couplings comprising:

a threaded hole formed in said platform structure; and a locking means with a threaded stem which is releasably screwed in said threaded hole.

9. Implement according to claim 8, wherein a seat is formed in said platform structure at said threaded hole, each support of said pair of supports comprising a wing which is selectively arrangeable in said seat, said wing being provided with a threaded hole into which said threaded stem is screwable to connect said wing to said platform structure.

10. Implement according to claim 9, wherein said wing is part of an L-shaped plate of said support, a sleeve being connected to said L-shape plate, a ball being connected to said sleeve, a complimentarily shaped socket joint interacting with said ball, said end of a respective user grip rod being rigidly coupled to said joint.

11. Implement according to claim 7, wherein said front portion has a curved front side and wherein said plurality of lateral couplings further comprise two forward lateral couplings arranged at said curved front side essentially symmetrically with respect to a longitudinal axis of said platform structure.

12. Implement according to claim 7 wherein each support of said pair of supports comprises a sleeve which extends laterally from said platform structure when said each support is connected to said platform structure, and wherein each rotatable connection of said pair of rotatable connections comprises a ball element connected to a free end of said sleeve and a socket joint connected to said end of a respective user grip rod, said socket joint being shaped complimentarily to said ball and being rotatably engaged about said ball.

13. Implement according to claim 7 wherein each grip rod of said pair of user grip rods is fitted with a shock absorber.

14. Implement according to claim 7 wherein said rear portion of said platform structure has an essentially rectangular plan shape.

15. Implement according to claim 7 wherein said flexible rocking elements comprise an inflatable ball which is arranged at said downward region of said platform structure selectively in one of a plurality of positions between a front and a rear of said platform structure.

* * * * *